United States Patent [19]

Lee

[11] Patent Number: 4,889,199

[45] Date of Patent: Dec. 26, 1989

[54] DOWNHOLE VALVE FOR USE WHEN DRILLING AN OIL OR GAS WELL

[76] Inventor: Paul B. Lee, 1216B - 18 Avenue NW., Calgary, Alberta, Canada, T2M 0W2

[21] Appl. No.: 54,713

[22] Filed: May 27, 1987

[51] Int. Cl.[4] ..... E21B 34/14

[52] U.S. Cl. ..... 175/317; 166/154; 166/318

[58] Field of Search ..... 166/154, 194, 318, 317, 166/142, 320, 148, 149, 150, 151, 185, 187, 284, 183, 184, 321; 175/237, 317, 325; 137/67, 71

[56] References Cited

U.S. PATENT DOCUMENTS

| | | | |
|---|---|---|---|
| 2,862,562 | 12/1958 | Hughes | 166/151 |
| 2,946,565 | 7/1960 | Williams | 175/325 |
| 3,007,523 | 11/1961 | Vincent | 166/318 X |
| 3,422,673 | 1/1969 | Lebourg | 166/187 |
| 3,503,445 | 3/1970 | Cochrum et al. | 166/151 |
| 3,542,130 | 11/1970 | Stout | 166/318 |
| 3,606,924 | 9/1971 | Malone | 166/187 |
| 3,878,889 | 4/1975 | Seabourn | 166/154 X |
| 3,908,769 | 9/1975 | Schuyf et al. | 166/184 |
| 4,574,894 | 3/1986 | Jadwin | 166/318 |

*Primary Examiner*—Bruce M. Kisliuk
*Attorney, Agent, or Firm*—George H. Dunsmuir; William R. Hinds

[57] ABSTRACT

A downhole drilling device utilizing a spring-loaded sleeve within the casing for controlling circulation of fluid material. A plastic, i.e., deformable ball is used to block a flow opening in the sleeve for positioning the sleeve and aligning flow ports. Subsequently, the ball is deformed and the drilling operation continues. In one form, an expandable packer may be operated to close off the annulus about the casing.

16 Claims, 10 Drawing Sheets

DOWNHOLE VALVE FOR USE WHEN DRILLING AN OIL OR GAS WELL

BACKGROUND OF THE INVENTION

This invention relates to a device for use in downhole drilling, and in particular to a downhole device for use when drilling an oil or gas well.

During the drilling of oil or gas wells, problems often arise because of differences in the pressures in the geological formation being drilled and at the surface, or between the pressure of the drilling mud and the formation pressure. Three major problems of this type include blowouts, differential sticking and mud circulation loss. Any of these problems can be extremely dangerous, and often require expensive solutions.

BRIEF SUMMARY OF THE INVENTION

Accordingly, the present invention relates to a downhole drilling device for a hollow drill string; first outlet means in said casing means for discharging fluid from said casing means; sleeve means slidably mounted in said casing means; spring means in said casing means biasing said sleeve means to a closed position in which said sleeve means closes said first outlet means; second outlet means in said sleeve means for discharging fluid from said sleeve means when said first and second outlet means are aligned; and retainer means in said sleeve means for releasably retaining a ball, whereby when a ball is placed in said sleeve means to prevent the normal flow of drilling fluid through said sleeve means, said sleeve means is caused to move relative to said casing means into an open position in which said first and second outlet means are aligned to discharge fluid from above the ball through said casing means.

BRIEF DESCRIPTION OF THE DRAWINGS

The invention will be described in greater detail with reference to the accompanying drawings, which illustrate preferred emobdiments of the invention, and wherein.

FIGS. *7a, 7b, 7c,* and *8a, 8b,* and *8c* are longitudinal sectional views of the device of FIG. 6 on a larger scale.

DESCRIPTION OF THE PREFERRED EMBODIMENT(S)

Figure 1:
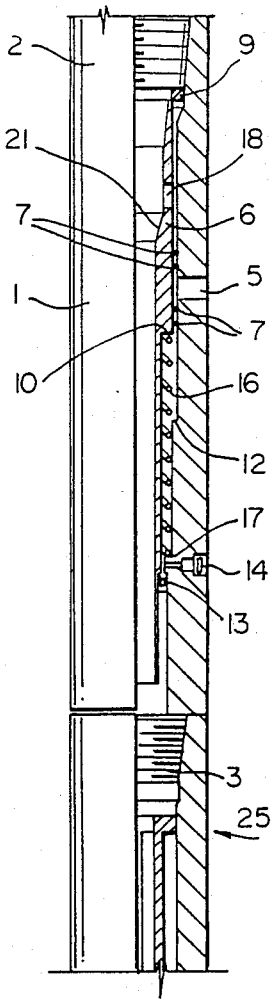
FIGS. 1 to 4 are partly sectioned side views of the downhole drilling device in accordance with the present invention.

With reference to FIGS. 1 to 4, one embodiment of the downhole device of the present invention is a bypass sub defined by a tubular casing 1 with an internally threaded top end 2, and an externally threaded bottom end 3 for mounting the casing 1 in a drill string. An outlet opening 5 is provided on one side of the casing 1 for discharging fluid from the interior of the casing. The opening 5 is normally closed by a sleeve 6, which is slidably mounted in the casing 1. 0-rings 7 above and below the opening 5 provide fluid seals between the casing 1 and the sleeve 6. The sleeve 6 is retained in the casing 1 by a retainer ring 9 mounted in the casing beneath the threaded top end 2 thereof. Downward movement of the sleeve 6 in the casing is limited by a shoulder 10 on the sleeve 6 and a ledge 12 on the interior of the casing 1. Vertical movement of an annular floating piston 13 is facilitated by movement of the sleeve 6. A chamber containing a spring 16, i.e. the chamber defined by the bottom, outer wall of the sleeve 6, the interior of the casing 1, the shoulder 10 and an annular ledge 17 contains hydraulic fluid. Rotation of the sleeve 6 in the casing 1 is prevented by a guide pin 14 extending radially inwardly through the casing 1 into a longitudinally extending slot (not shown) in the outer surface of the sleeve 6. The sleeve 6 is biased to the closed position over the opening 5 by the helical spring 16, which extends between the shoulder 10 and the annular ledge 17 above the guide pin 14. An outlet opening 18 is provided in one or more sides of the sleeve 6. The outlet opening 18 is vertically aligned with the opening 5 in the casing 1.

Figure 2:
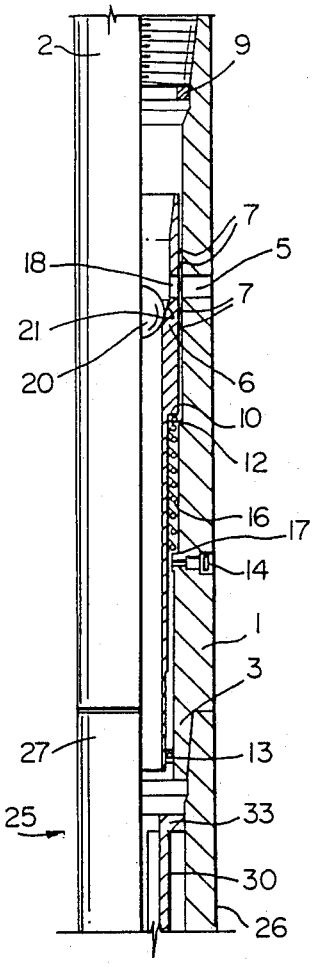
Figure 3:
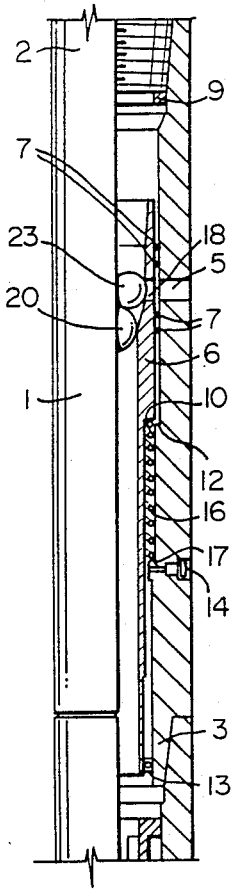
Figure 4:
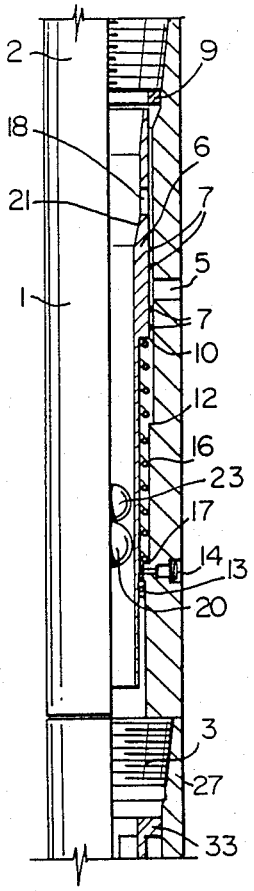

During a lost circulation condition, i.e. when drilling fluid is being lost to the formation, and it is desired to inject lost circulation material into the formation, the drill string is broken at the surface, and a large plastic ball 20 is placed therein. The ball 20 descends to the casing 1 (i.e. to the bypass sub). The ball 20 can be pumped through a portion of the drill string above the casing 1 in order to speed up feeding of the ball. However, pumping should be stopped at least two barrels before the ball 20 reaches the casing 1 (FIG. 2). Subsequently, the ball engages an inwardly inclined shoulder 21 on the interior of the sleeve 6. The pump pressure in the drill string causes the ball 20 to push the sleeve 6 downwardly against the force of the spring 16 until the shoulder 10 engages the ledge 12. In this position, the openings 5 and 18 are aligned, so that lost circulation material such as woodchips can be discharged into the formation. Once the formation has been sealed, the string is again broken at the surface, and a smaller metal ball 23 (FIG. 3) is dropped into the string. Pumping is then continued to cause the metal ball 23 to bear against the opening 18. Continued pumping of drilling mud into the casing 1 forces the balls 20 and 23 downwardly through the sleeve 6 into a ball catcher device generally indicated at 25. This procedure can be repeated as often as necessary. It is necessary to ensure that all of the loose circulation material is discharged from the casing 1 in order to prevent plugging of the bit jets (not shown).

Figure 5:
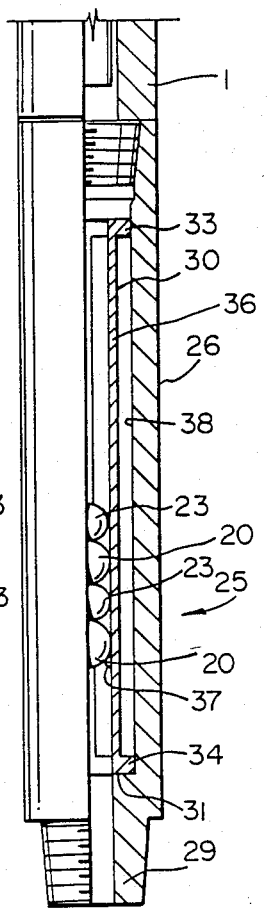
FIG. 5 is a partly sectioned side view of a ball catcher device for use with the drilling device of FIGS. 1 to 4.

Referring to FIG. 5, the ball catcher device 25 is defined by a tubular casing 26, with an internally threaded top end 27 and an externally threaded bottom end 29 for mounting the casing in a drill string. A ball retainer sleeve 30 is mounted on a shoulder 31 in the casing 26. The sleeve 30 is defined by annular top and bottom ends 33 and 34, respectively and thin strips or ribs 36 extending vertically between such ends 33 and 34. An annular stop 37 is provided on the interior of the sleeve 30 near the bottom end thereof.

Thus, the balls 20 and 23 discharged from the casing 1 enter the casing 26 and are retained by the sleeve 30 while permitting the flow of drilling fluid through the passage 38 surrounding the sleeve 30, and through the spaces between the ribs 36.

Figure 6:
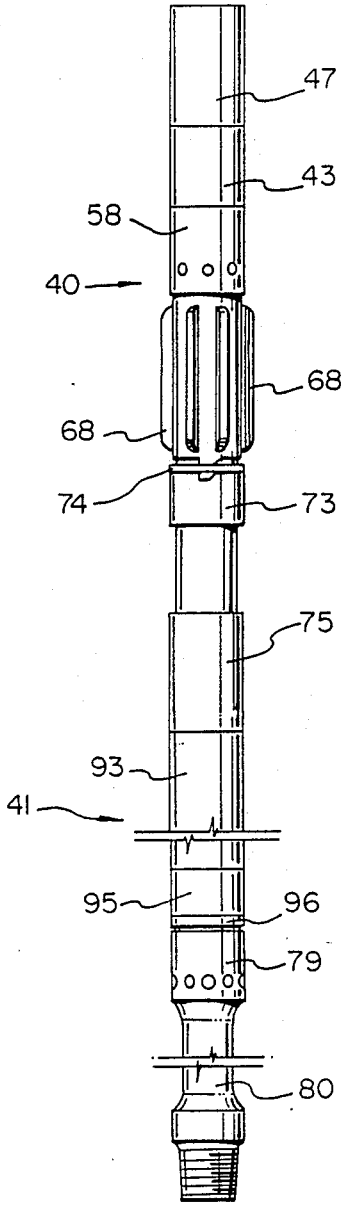
FIG. 6 is a schematic, longitudinal sectional view of a second embodiment of the device of the present invention.
Figure 7A:
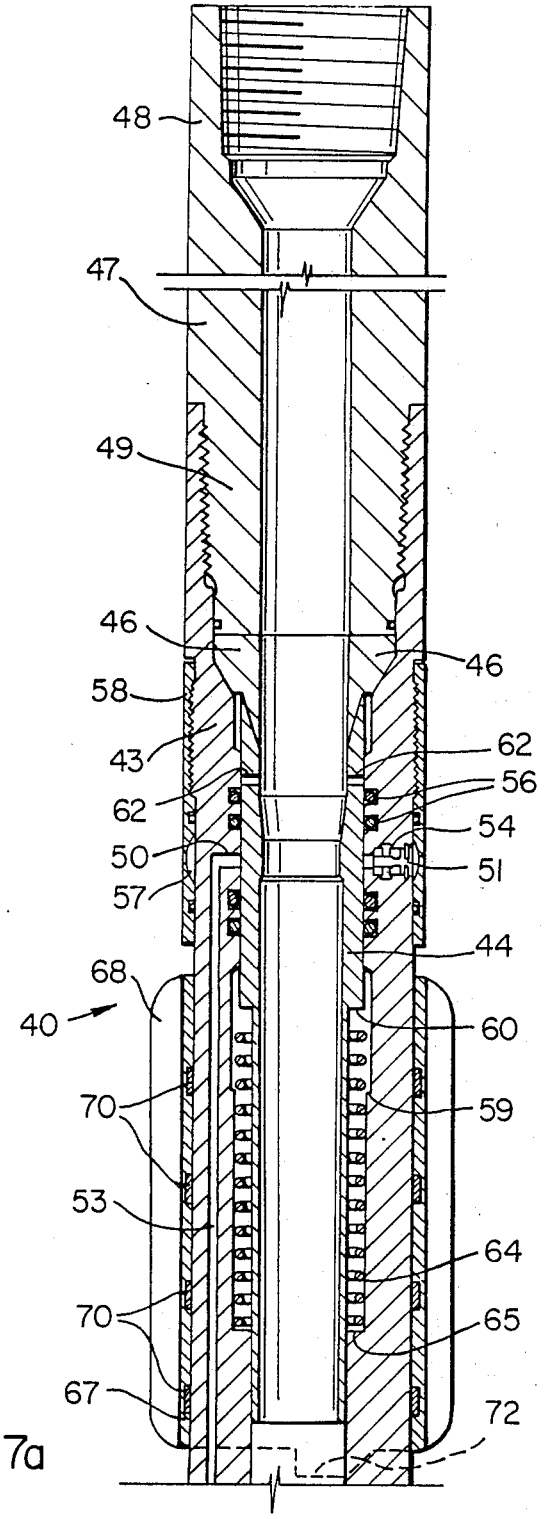
Figure 7B:
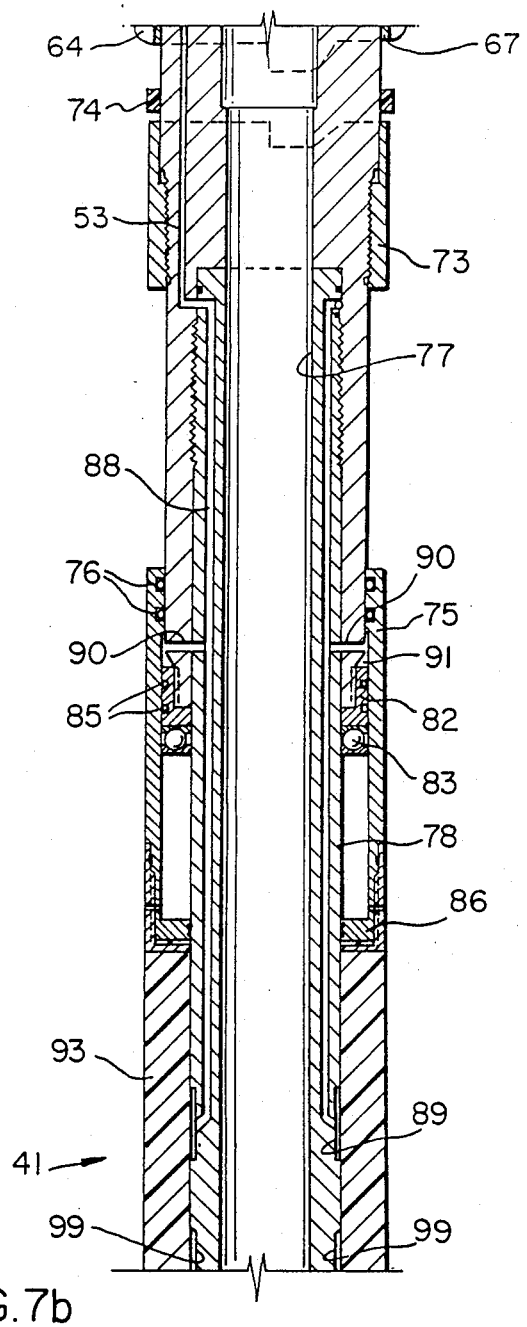
Figure 7C:
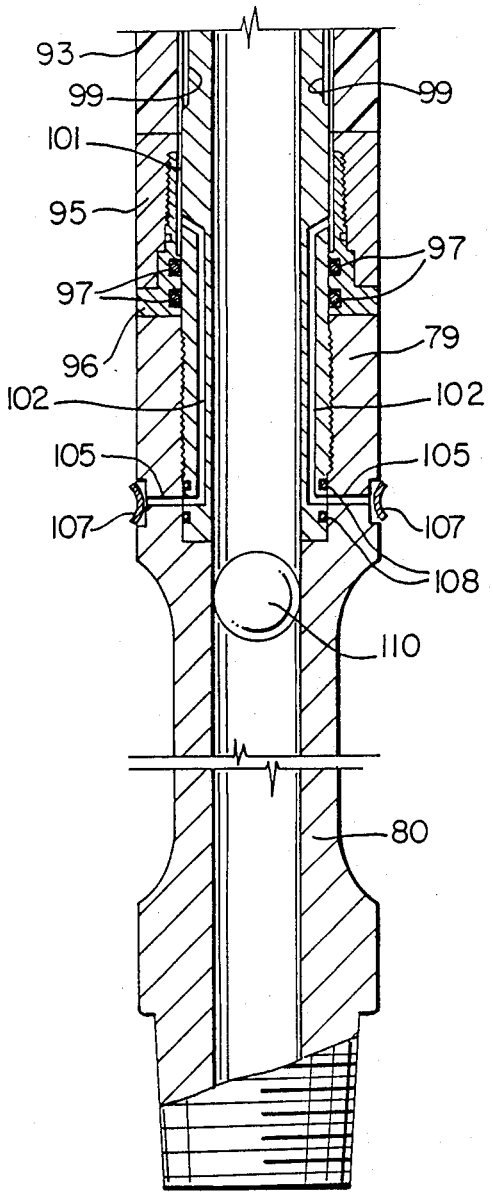
Figure 8A:
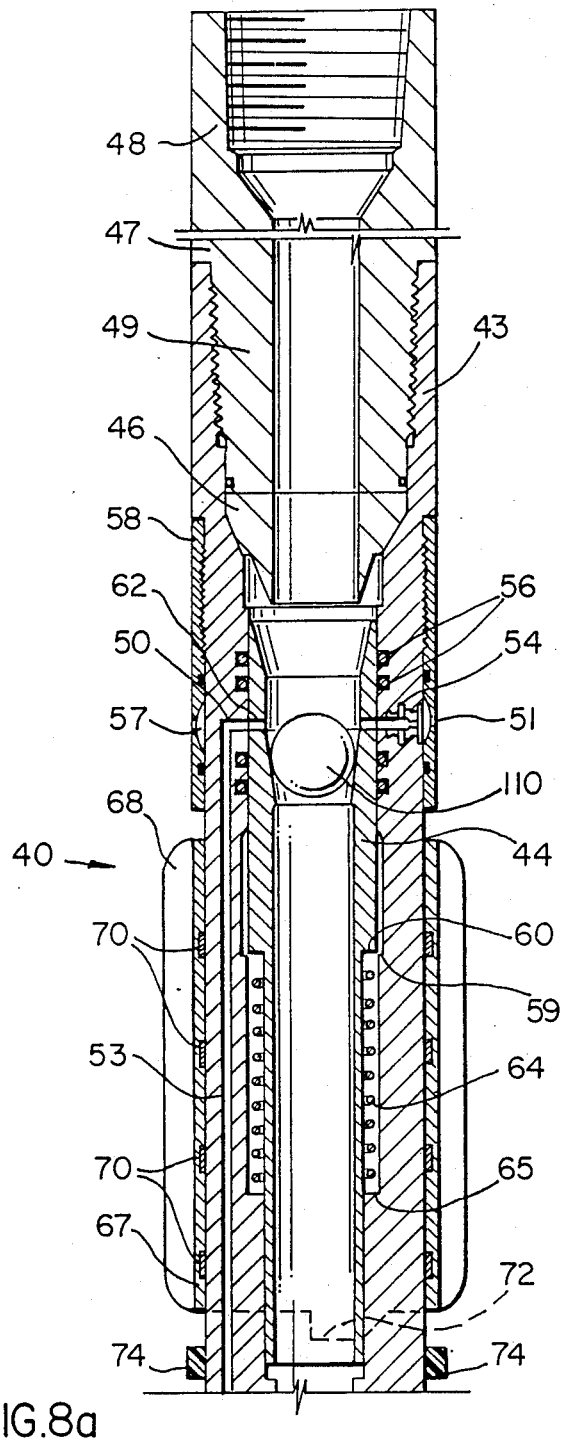
Figure 8B:
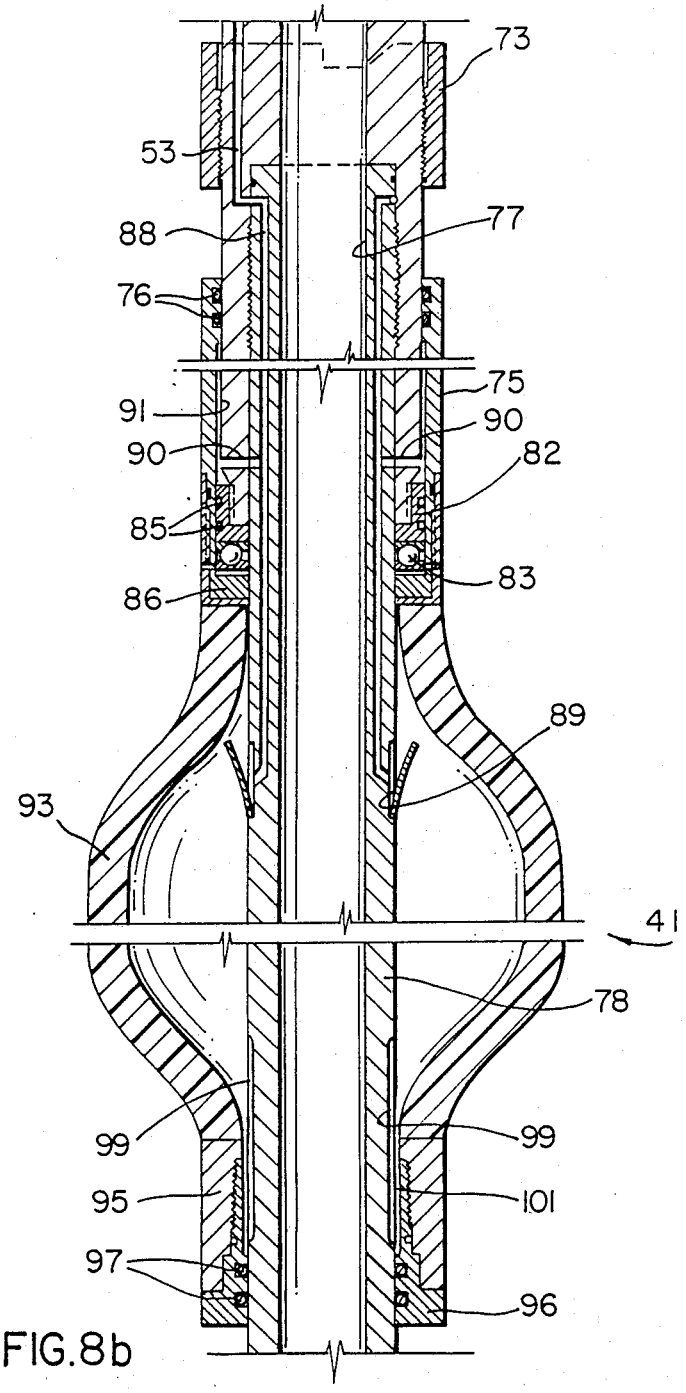
Figure 8C:
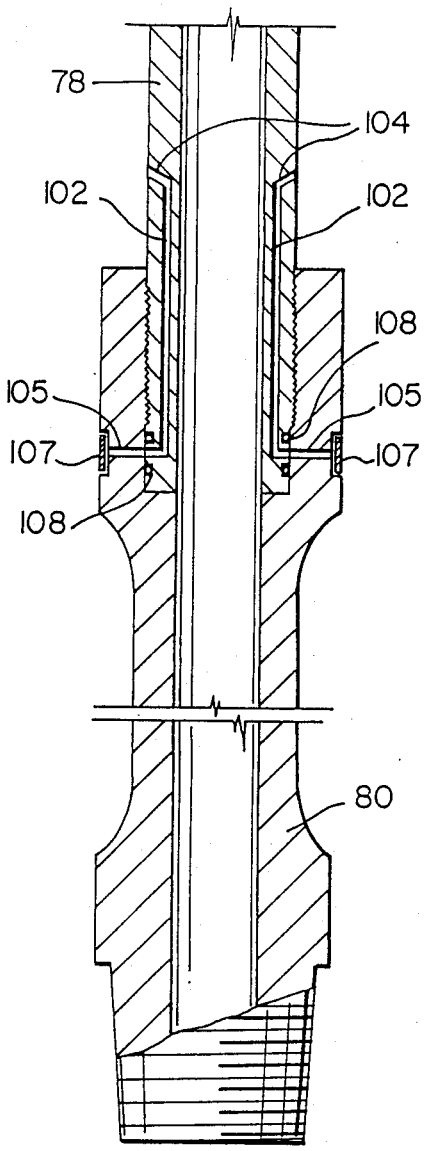

With reference to FIGS. 6 to 8, a second embodiment of the invention includes the same basic elements of the first embodiment, namely a bypass sub generally indicated at 40, and an inflatable packer generally indicated at 41. The bypass sub 40 is defined by a casing 43 for slidably housing a sleeve 44. The sleeve 44 is retained in the casing 43 by a retainer ring 46 and a top sub defined by a casing 47. The casing 47 has an internally threaded top end 48 and an externally threaded bottom end 49 for mounting the casing 47 in a drill string and in the casing 43.

Like the sleeve 6, the sleeve 44 is slidably mounted in the casing 43 for normally closing outlets 50 and 51 (one of each shown). The outlets 50 define the top ends of passages 53 extending downwardly through the casing 43, and the outlets 51 are located in radially extending ports 54 (one shown) in the casing 43. 0-rings 56 provide seals between the casing 43 and the sleeve 44 above and below the openings 50 and 51.

The ports 54 extend through the casing 43 to circulating jets or orifices 57 in a circulation cap defined by a sleeve 58 mounted on the casing 43.

The upper limit of travel of the sleeve 44 in the casing 43 is determined by the retainer ring 46. The lower limit of travel of the sleeve 44 is determined by a ledge 59 in the casing 43, and a shoulder 60 on the sleeve 44. Outlet openings 62 are provided in the sleeve 44. Such outlets are normally above and vertically aligned with the outlets 50 and 51 in the casing 43. The sleeve 44 is normally retained in the upper closed position by a helical spring 64 extending between the shoulder 60 and a second ledge 65 in the casing 43. A stabilizer defined by a sleeve 67 and a plurality of longitudinally extending fins 68 is slidably mounted on the casing 43. The stabilizer is formed of polyurethane or steel, and does not rotate with the casing 43. Annular friction pads 70 are provided between the casing 43 and the sleeve 67. Teeth 72 (one shown) are provided on the bottom end of the casing 43 for engaging the top end of a cylindrical wash over clutch 73. A spacer ring 74 is provided between the stabilizer and the clutch 73.

The casing 43 extends downwardly into the cylindrical top cap 75 of the packer 41. Seals 76 are provided between the cap 75 and the casing 43. The casing 43 is internally threaded near the bottom end thereof for retaining the externally threaded top end 77 of a cylindrical mandrel 78, which extends through the packer to the internally threaded top end 79 of an elongated, tubular flex joint 80. The packer 41 is slidably mounted on the bottom end of the casing 43 and the mandrel 78 by means of a retainer nut 82 and a thrust bearing 83. Seals 85 are provided between the nut 82 on the bottom end of the casing 43 and the interior of the top cap 75. A seal 86 is provided at the base of the top cap 75. The passages 53 in the casing 43 extend downwardly and then radially inwardly into fluid communication with the top ends of longitudinally extending passages 88 in the top end of the mandrel 78. The bottom ends of the passages 88 are closed by a flexible, annular check valve 89. Passages 90 extend radially outwardly from the passages 88 through the mandrel 78 and the casing 43 into fluid communication with a cylindrical chamber 91 between the casing 43 and the top cap 75 of the packer 41.

The body of the packer 41 is defined by a flexible, inflatable cylinder 93 which is connected to the bottom end of the top cap 75. The rigid bottom end 95 of the packer body is internally threaded for connecting the bottom nd of the packer to an externally threaded bottom cap 96. Seals 97 are provided between the bottom cap 96 and the mandrel 78. Longitudinally extending recesses or flutes 99 are provided in the mandrel communicating with an annular passage 101 between the bottom end of the mandrel 78 and the bottom end 95 of the packer 41. Should an over inflation situation occur, fluid will be discharged from the packer 41 via the flutes 99, the passage 101 in the bottom end of the packer, and passages 102 in the mandrel 78. The passages 102 include inclined, radially extending top ends 104, and radially extending bottom ends aligned with radially extending passages 105 in the top end of the flex joint 80. The outer ends of the passages 105 are normally closed by a flexible check valve 107. Seals 108 are provided between the bottom end of the mandrel 78 and the flex joint 80 above and below the passages 105.

During normal operation of the drill string, the packer 41 seats on the flex joint 80 (FIG. 7*c*). When it is desired to inflate the packer 41, the drill string is broken at the surface, a ball 110 is dropped into the string, and the connection is retorqued. If desired, the ball 110 can be pumped a portion of the distance to the device. When the ball 110 seats in the top end of the sleeve 44 (FIG. 8*a*), additional drilling fluid pumped into the string forces the sleeve 44 downwardly so that the openings 62 are aligned with the openings 50 and 51. The drilling fluid then passes through the passages 53, 88 and 90 into the chamber 91 to push the packer 41 upwardly on the mandrel 78 to the upper position. In such position, the discharge passages 102 no longer communicate with the bottom of the packer 41. With the packer 41 in its uppermost position, the drilling fluid passes through the one-way check valve 89 into the space between the mandrel 78 and the packer body 93 to inflate the latter against the walls of the well.

In order to deflate the packer 41, pumping pressure is increased to force the ball 110 downwardly through the sleeve 44, the mandrel 78 and the flex joint 80 into a ball catcher sub (not shown) or device of the same type as shown in FIG. 5. Any additional mud passing down the string will flow through the sleeve 44, the mandrel 78, the joint 80 and the ball catcher device. The drill string is lifted. The inflated packer body 93 will stick to the walls of the well, and the casing 43 and the mandrel 78 attached thereto slide upwardly. Thus, the top ends 104 of the passages 102 enter the packer body 93, and fluid escapes through the passages 102 and the check valve 107 (FIG. 7*c*).

Since the third embodiment of the invention (FIGS. 9 and 10) is similar to the device of FIGS. 1 to 4, wherever possible the same reference numerals have been used to identify the same or similar elements.

Figure 9:
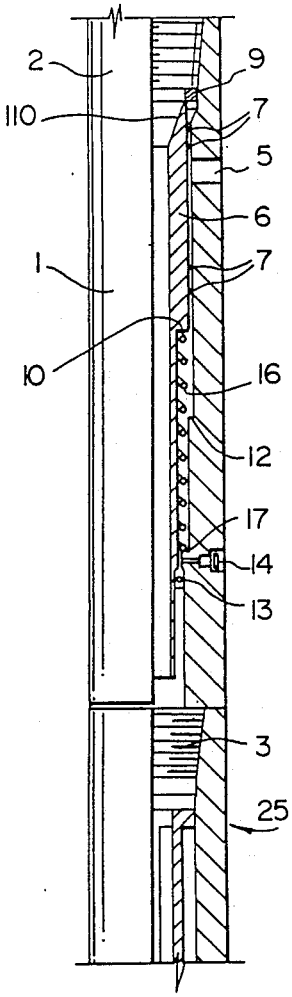
FIGS. 9 and 10 are partly sectioned side views of a third embodiment of the device of the present invention.
Figure 10:
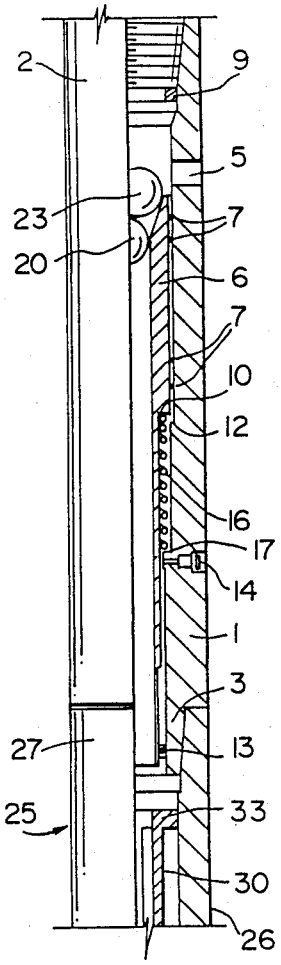

Referring to FIGS. 9 and 10, the basic difference between the third and first embodiments of the invention is that the opening 18 and the shoulder 21 are omitted from the sleeve 21. Thus, the thickness of the top portion of the sleeve 6 is constant from the internally bevelled top end 110 thereof to the shoulder 10. The 0-rings 7 are mounted in and carried by the sleeve 6. The 0-rings 7 are normally located above and below the opening 5 in the casing 1.

The operation of the third embodiment of the invention is the same as that of the first embodiment, except that the large plastic ball 20 seats on the top end 110 of the sleeve 6. Pump pressure causes the ball 20 to push the sleeve 6 downwardly against the force of the spring 16 until the shoulder 10 engages the ledge 12. In this position, the top end 110 of the sleeve 6 is below the opening 5, so that lost circulation material can be discharged into the formation. Once the formation has been sealed, the string is again broken at the surface, and a smaller metal ball 23 (FIG. 10) is dropped into the string. Pumping is then continued to cause the metal ball 23 to bear against the opening 5. Continued pumping of drilling mud into the casing 1 forces the balls 20 and 23 downwardly through the sleeve 6 into the ball catcher device 25.

USES

Blowout prevention: During conventional blowout prevention, when the hydrostatic pressure in the drill string is too low, the entire drill string must be filled as quickly as possible with heavy mud to hold gas in the formation. If heavy mud filling is not accomplished sufficiently quickly, gas starts to move up the hole to the surface. As the gas rises it expands. Conventional blowout tools are used to seal the hole at the surface where the gas pressure is highest and the danger the greatest. Surface tools give a variety of results, are sometimes ineffective and often leave a well sealed and useless.

When using the device of the present invention, as soon as a so-called "kick" occurs, presaging a blowout, the packer 41 is inflated in the manner described above. The prevention or control of blowouts in a hole is better than ground level action, since the gas at the downhole location has less opportunity to expand than when rising to the surface. By bleeding off the gas and adjusting the hydrostatic pressure in the string to counteract downhole gas pressure, drilling can be continued in relative safety.

Differential sticking: —Excessive mud weight acting on a porous or low pressure formation can cause the drilling string to become jammed against the wall or differentially stuck. By inflating the packer 41 and continuing to feed mud under pressure through the ports 54 and the jets 51, it is possible to circulate drilling mud above the packer 41 only. Pressure below the packer 41 is reduced, lessening friction on the drill string. The torque on the string can be increased, and the torque will be transferred below the packer 41 to the problem area to free the string. Once the string is free, rotation is continued, and pressure in the string is increased to free the ball 110.

Alternatively, after the ball 110 has reached the sleeve 44, water or a lighter (less dense) fluid is used to remove the heavy mud from the drill string via ports 54, and the pressure is increased to drive the ball 110 through the sleeve 44 to the ball catcher device. The pressure below the packer 41 will equalize with the reduced pressure in the drill string to create a U-tube effect which should free the pipe. The lighter fluid can be reverse circulated out of the string.

Preventing lost circulation: —Normally, it is not possible to control the flow of annular fluid in the event of lost circulation. By expanding the packer 41 the annulus below the packer can be sealed, and circulation restricted to the area above the packer. Once suitable lost circulation material has been prepared by the operator, the material can be pumped downwardly to shortly above the ball 110. The pressure is increased to force the ball 110 through the device, and to circulate the lost circulation material into the weak formation beneath the packer 41. The material is permitted to set or, if necessary, forced into the formation under pressure.

What is claimed is:

1. A downhole drilling device for a hollow drill string comprising tubular casing means for mounting in a drill string; first outlet means in said casing means for discharging fluid from said casing means; sleeve means slidably mounted in said casing means; spring means in said casing means biasing said sleeve means to a closed position in which said sleeve means closes said first outlet means; second outlet means in said sleeve means for discharging fluid from said sleeve means when said first and second outlet means are aligned; a ball, retainer means in said sleeve means for releasably retaining said ball for preventing flow of drilling fluid through said sleeve means and causing said sleeve means to move relative to said casing means into an open position in which said first and second outlet means are aligned to discharge fluid through said casing means, a second ball for blocking said second outlet means so that pressure on said first and second balls increases sufficiently to drive said first ball through said sleeve means for restoring the normal flow of drilling fluid through said sleeve means and for allowing the return of said sleeve means to said closed position.

2. A device according to claim 1, wherein said first outlet means includes radially extending openings in said casing means for discharging drilling fluid from said casing means into a surrounding formation.

3. A device according to claim 1, including ledge means in said casing means; and shoulder means on said sleeve means for engaging said ledge means to limit downward movement of said sleeve means against the force of said spring means to a position in which said first and second outlet means are aligned.

4. A device according to claim 1, including inflatable packer means on said casing means; and inlet passage means connecting said first outlet means to said packer means, whereby, when said sleeve means is moved to the open position, fluid flows through said inlet passage means into said packer means to inflate the latter.

5. A device according to claim 4, including one-way valve means in said casing means permitting the flow of fluid from said inlet passage means into said packer means, while preventing the reverse flow of fluid into said inlet passage means from said packer means.

6. A device according to claim 5, including outlet passage means in said casing means spaced remote from said packer means for discharging fluid from said packer means when said casing means is moved relative to said packer means.

7. A device according to claim 6, including bearing means between said casing means and said packer means facilitating relative radial movement between said casing means and said packer means.

8. A device according to claim 6 wherein said first outlet means includes a first opening in said casing means for passing drill fluid into said inlet passage means for inflating said packer means; and a second opening for discharging drilling fluid into a formation above said packer means.

9. A device according to claim 3, including tubular mandrel means providing an extension of said casing means; inflatable packer means slidably mounted on the bottom end of said casing means and on said mandrel means; inlet passage means in said mandrel means connecting said first outlet means to said packer means, whereby, when said sleeve means is moved to the open position fluid flows through said inlet passage means into said packer means to inflate the latter.

10. A device according to claim 9, including one-way valve means in said mandrel means permitting the flow of fluid from said inlet passage means into said packer means, while preventing the reverse flow of fluid into said inlet passage means from said packer means.

11. A device according to claim 10, including outlet passage means in said mandrel means spaced from said packer means for discharging fluid from said packer means when said casing means is moved relative to said packer means.

12. A device according to claim 11, including bearing means between said casing means and said packer means facilitating relative movement between said casing means and said packer means.

13. A device according to claim 11, wherein said first outlet means includes a first opening in said casing means for discharging drill fluid into said inlet passage means for inflating said packer means; and a second opening for discharging drilling fluid into a formation above said packer means.

14. A device according to claim 1 including ball catcher means for mounting in a drill string beneath said casing means for receiving said first and second balls when the balls are released from said sleeve means and pushed through said casing means, said ball catcher means including tubular sub means; and cage means in said sub means for catching the balls while permitting the flow of drilling fluid through the sub means.

15. A device according to claim 14, wherein said cage means includes a pair of spaced ring means in said sub means; web means extending between said ring means; and stop means on said web means between said ring means for retaining balls while permitting the flow of fluid around the balls.

16. A downhole drilling device for a hollow drill string comprising tubular casing means for mounting in a drill string; outlet means in said casing means for discharging fluid from said casing means; sleeve means slidably mounted in said casing means; spring means in said casing means biasing said sleeve means to a closed position in which said sleeve means closes said outlet means; a first ball, retainer means in said sleeve means for releasably retaining said first ball for preventing flow of drilling fluid through said sleeve means and causing said sleeve means to move relative to said casing means into an open position in which the top end of said sleeve means is located beneath said outlet means to discharge fluid through said casing means, a second ball for blocking said outlet means so that pressure on said first and second ball increases sufficiently to drive said first ball through said sleeve means for restoring the normal flow of drilling fluid through said sleeve means and for allowing the return of said sleeve means to said closed position.

* * * * *